US011064813B2

(12) United States Patent
Fu et al.

(10) Patent No.: US 11,064,813 B2
(45) Date of Patent: Jul. 20, 2021

(54) SOFTNESS-ADJUSTABLE MATTRESS

(71) Applicant: ZHEJIANG XIANGNENG SLEEP TECHNOLOGY STOCK CO., LTD., Zhejiang (CN)

(72) Inventors: Cunwei Fu, Zhejiang (CN); Feng Guo, Zhejiang (CN)

(73) Assignee: ZHEJIANG XIANGNENG SLEEP TECHNOLOGY STOCK CO., LTD., Zhejiang (CN)

( * ) Notice: Subject to any disclaimer, the term of this patent is extended or adjusted under 35 U.S.C. 154(b) by 186 days.

(21) Appl. No.: 16/415,038

(22) Filed: May 17, 2019

(65) Prior Publication Data

US 2020/0128968 A1 Apr. 30, 2020

(30) Foreign Application Priority Data

Oct. 31, 2018 (CN) ..... 201811286255.3

(51) Int. Cl.
*A47C 27/08* (2006.01)
*A47C 27/00* (2006.01)
(Continued)

(52) U.S. Cl.
CPC ..... *A47C 27/083* (2013.01); *A47C 27/001* (2013.01); *A47C 27/128* (2013.01); *A47C 27/18* (2013.01)

(58) Field of Classification Search
CPC ... A47C 27/001; A47C 27/081; A47C 27/082; A47C 27/083; A47C 27/128; A47C 27/18
See application file for complete search history.

(56) References Cited

U.S. PATENT DOCUMENTS 4,224,706 A * 9/1980 Young ..... A47C 27/18 5/710
4,809,375 A * 3/1989 Bull ..... A47C 21/048 5/722

(Continued)

FOREIGN PATENT DOCUMENTS

CN 1736293 2/2006
CN 105615393 6/2016

(Continued)

*Primary Examiner* — David R Hare
(74) *Attorney, Agent, or Firm* — Hauptman Ham, LLP

(57) ABSTRACT

The disclosure discloses a softness-adjustable mattress, including an outer lining, an outer lining zipper, and a bottom lining, wherein the bottom lining is positioned on the outer lining, the outer lining zipper is positioned between the outer lining and the bottom lining, a lying-down mechanism is mounted on an inner lower wall face of the outer lining, and an inflation mechanism is mounted on the lying-down mechanism. The beneficial effects of the disclosure is having the characteristic of being quickly mounted and dismounted; through an air cushion the overall comfort degree of the mattress can be enhanced, and can prevent the integral mattress shape from collapsing; the air cushion can be inflated by the inflation controller at all times, thereby ensuring the stability of the air cushion; users can lie down on the wavy cotton, which improves the users' comfort degree and brings convenience to people's life. Moreover, the edges or corners of the air cushion of the disclosure are capable of maintaining a certain shape even under some pressure. Preferably, the air cushion of the disclosure has excellent durability.

10 Claims, 5 Drawing Sheets

(51) Int. Cl.
*A47C 27/12* (2006.01)
*A47C 27/18* (2006.01)

(56) References Cited

U.S. PATENT DOCUMENTS

| | | | | | |
|---|---|---|---|---|---|
| 4,991,244 | A * | 2/1991 | Walker | A47C 27/082 | 5/400 |
| 5,249,319 | A * | 10/1993 | Higgs | A47C 27/082 | 5/713 |
| 5,325,551 | A * | 7/1994 | Tappel | A47C 27/082 | 5/709 |
| 7,661,166 | B1 * | 2/2010 | Marling | A47C 27/146 | 5/738 |
| 10,624,469 | B2 * | 4/2020 | Carlitz | A47C 27/148 | |
| 2010/0170044 | A1 * | 7/2010 | Kao | A47C 27/10 | 5/710 |
| 2010/0287707 | A1 * | 11/2010 | Beard | A47C 27/001 | 5/706 |

FOREIGN PATENT DOCUMENTS

| | | | | | |
|---|---|---|---|---|---|
| KR | 20170050473 | A * | 5/2017 | | |
| WO | WO-9321803 | A1 * | 11/1993 | A47C 4/54 | |
| WO | WO-2011156891 | A1 * | 12/2011 | A47C 27/085 | |

* cited by examiner

SOFTNESS-ADJUSTABLE MATTRESS

TECHNICAL FIELD

The disclosure relates to a technical field of mattress, especially a softness-adjustable mattress.

BACKGROUND

Following people's higher requirements of material life, people's requirements on mattress, which is an ubiquitous article in life, are also increasing, so various mattresses appear in our field of vision, e.g. the invention patent with the application number of 201710228764.x comprises a first outer frame, a second outer frame and a first mattress. The softness of the mattress in this invention can be adjusted according to necessities; however, the mattress is weak in comfort degree, and cannot be easily mounted or dismounted for handling or storing, which brings lots of troubles to people's life.

Different from common inflatable products, the softness-adjustable mattress needs to have more normative shape after being inflated, which is usually a cuboid shape. In the traditional inflatable products, by the connection between the upper and lower sheets of a bed body via a plurality of pulling belts so that the inflated mattress can form two flat surfaces, a cuboid shape can be obtained. For example, the inflation product and inflation product welding process disclosed in CN105615393A, and the airbed combination disclosed in CN1736293A. Wherein the airbed combination of CN1736293A have two twin-sized cuboid airbeds. However, for the reason of inflation, the vertical edges of the airbed, especially the vertical edges around the corner, may easily and excessively depressed when being squeezed by external forces, e.g. when such area being seated by a human body, which affects the using feeling of the inflatable products.

On the other hand, most of the current inflatable products are prepared by using the material obtained by coating the substrate with polyvinyl chloride (PVC). This kind of material can be used as a good tightness material for inflatable products, but it still has many shortcomings. For instance, PVC material may easily be punctured or worn, therefore the material has to have a certain thickness; if the stressed area is small, the material may be easily pulled open and result in air leak. As a result, there are still needs to develop new materials of inflatable products.

SUMMARY OF THE INVENTION

The object of the disclosure is to solve the afore-mentioned problem by designing a softness-adjustable mattress.

In order to realize the afore-mentioned object, the technical solution of the disclosure is as follows: A softness-adjustable mattress, including an outer lining, an outer lining zipper, and a bottom lining, wherein the bottom lining is positioned on the outer lining, the outer lining zipper is positioned between the outer lining and the bottom lining, a lying-down mechanism is mounted on an inner lower wall face of the outer lining, and an inflation mechanism is mounted on the lying-down mechanism;

wherein the lying-down mechanism comprises: an inner lining, an inner lining zipper, and wavy cotton;

the wavy cotton being positioned on the inner lower wall face of the outer lining, the inner lining being positioned on the wavy cotton, and the inner lining zipper being positioned between the inner lining and the outer lining;

wherein the inflation mechanism comprises a first inflation structure and a second inflation structure;

the first inflation structure being positioned on the inner lining and inside of the outer lining, and the second inflation structure being inserted into an inner left side of the first inflation structure;

wherein the first inflation structure comprises: a pair of air cushions of the same structure, a pair of first spongy strips of the same structure, a spongy cushion, a second spongy strip and a third spongy strip;

the pair of the first spongy strips being positioned on the inner front and back wall faces of the outer lining and on the inner lining, the second spongy strip being positioned on an inner right wall face of the outer lining and on the inner lining, the third spongy strip being positioned on an inner left wall face of the outer lining and on the inner lining, the pair of the air cushions being positioned between the pair of the first spongy strips, and the spongy cushion being positioned on the pair of the air cushions;

wherein the second inflation structure comprises a first conduit, an inflation controller, a second conduit and palm-substituent cotton;

the inflation controller being inserted into an inner rear part of the third spongy strip, a trapezoid groove being provided on an inner wall face of the third spongy strip and at the front part of the inflation controller; the first conduit being provided on a front wall face of the inflation controller and inside of the trapezoid groove; the first conduit being connected with the air cushion close to the front part, the second conduit being positioned on the front wall face of the inflation controller and on the first conduit, the second conduit being inserted inside of the trapezoid groove and being connected with the air cushion close to the rear part, the palm-substituent cotton being positioned on the inflation controller, and the palm-substituent cotton being connected with an inner wall face of the third spongy strip.

The air cushion (3) comprises a first surface, a second surface, a side surface and pulling strips, wherein:

the first surface has the same shape as the second surface, and the first surface, the second surface and the side surface are respectively made of a flexible impermeable material; the first surface and the second surface are respectively connected with the side surface, thereby forming a sealed accommodating cavity;

the pulling strips are located within the accommodating cavity, one end of the pulling strip is provided on one side of the first surface facing the accommodating cavity, and the other end of the pulling strip is provided on one side of the second surface facing the accommodating cavity, thereby keeping the first surface and the second surface flat when the accommodating cavity is inflated.

The side surface includes a first edge, a second edge, a third edge and a fourth edge, wherein the edges of the first surface are connected with the first edge of the side surface, the edges of the second surface are connected with the third edge of the side surface, the second edges of the side surface are connected with the fourth edges of the side surface, thereby forming a sealed accommodating cavity.

The first surface and the second surface are respectively quadrilateral, and the side surface includes a first side surface, a second side surface, a third side surface and a fourth side surface, wherein the first side surface is respectively connected with a first edge of the first surface and a first edge of the second surface, the second side surface is respectively connected with a second edge of the first surface and a second edge of the second surface, the third side surface is respectively connected with a third edge of the first surface and a third edge of the second surface, the fourth side surface is respectively connected with a fourth edge of the first surface and a fourth edge of the second surface, and the first side surface, the second side surface, the third side surface and the fourth side surface are interconnected, thereby forming a cuboid sealed accommodating cavity.

The flexible impermeable material comprises a base material and a polymer material layer provided on the surface of the base material, the polymer material layer being prepared from raw materials containing natural rubber, styrene butadiene rubber, rosin resin, bis-((3-methyl-2,5-dioxopyrrol-1-yl)methyl)benzol and thiols.

In the polymer material layer, the natural rubber is 65-75 parts by weight, the styrene butadiene rubber is 25-35 parts by weight, the rosin resin is 1-5 parts by weight, the bis-((3-methyl-2,5-dioxopyrrol-1-yl)methyl)benzol is 1-5 parts by weight, and the thiols is 2-5 parts by weight.

The inflation controller is provided with two pairs of first screw holes of the same structure, and the palm-substituent cotton is provided with two pairs of second screw holes of the same structure, and two pairs of bolts of the same structure are spirally mounted between the two pairs of the first screw holes and the two pairs of the second screw holes.

The length of the first spongy strip is larger than that of the second spongy strip, and the length of the second spongy strip is the same as that of the third spongy strip.

The first conduit is in spiral connection with the air cushion close to the front part, and the second conduit is in spiral connection with the air cushion close to the rear part.

The left end face of the bottom lining is in sutured connection with the outer lining, and the left end face of the inner lining is in sutured connection with the outer lining.

The mattress, which is made by using the technical solution of the disclosure, can be quickly mounted and dismounted; the air cushion can enhance the overall comfort degree of the mattress, and prevent the integral mattress shape from collapsing; the air cushion can be inflated by the inflation controller at all times, thereby ensuring the stability of the air cushion; users can lie down on the wavy cotton, which improves the users' comfort degree and brings convenience to people's life.

Moreover, the softness-adjustable mattress, especially the edges or corners of the air cushion, is capable of maintaining a certain shape even under some pressure. Besides, most of current air cushions use polyvinyl chloride (PVC) as a raw material; however, the air cushion of the disclosure overcomes this shortcoming, and is capable of resisting long-term variation of stresses and has an excellent durability.

Figure 1:
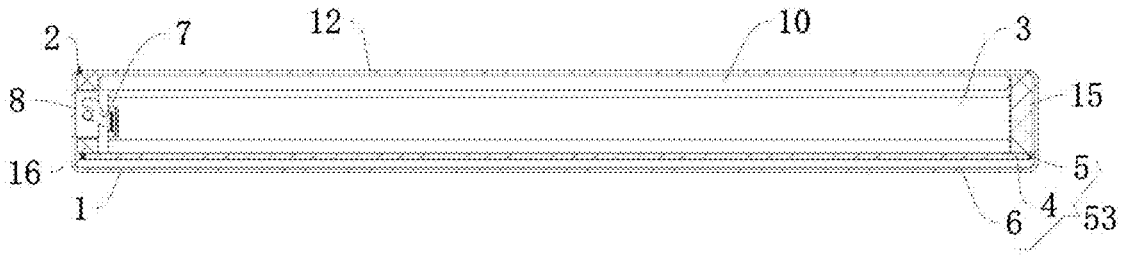
FIG. 1 is a structure diagram of the softness-adjustable mattress of the disclosure.
Figure 2:
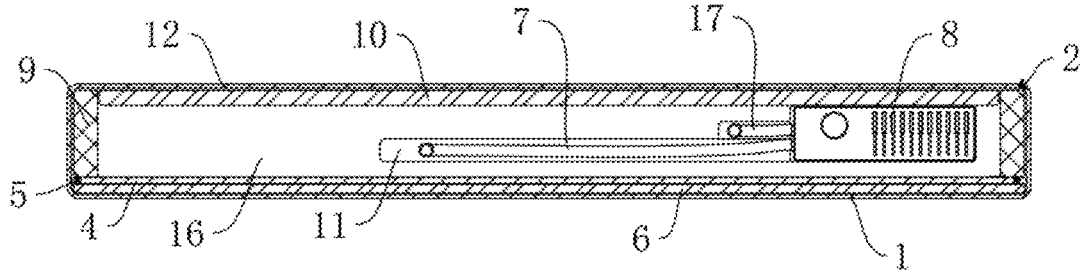
FIG. 2 is a right-viewing sectional structure diagram of the softness-adjustable mattress of the disclosure.
Figure 3:
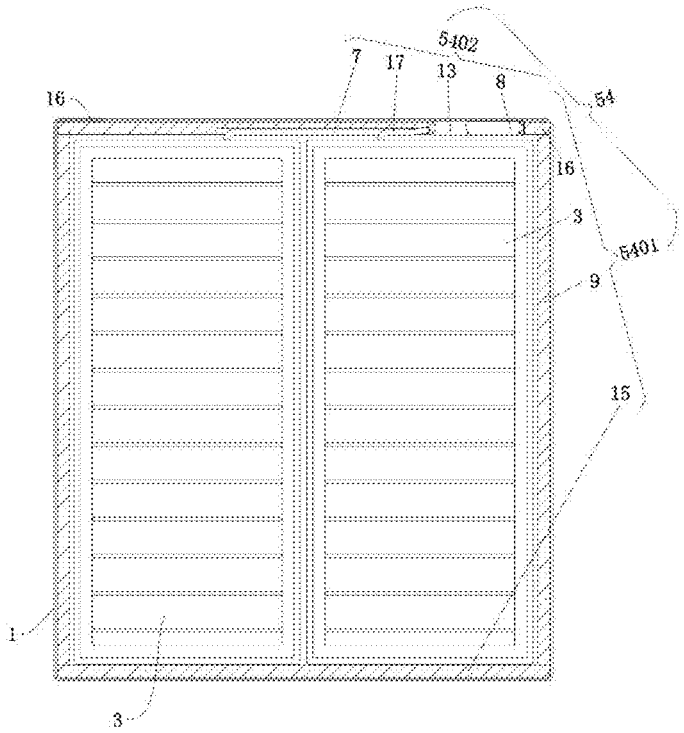
FIG. 3 is an overlooking sectional structure diagram of the softness-adjustable mattress of the disclosure.
Figure 4:
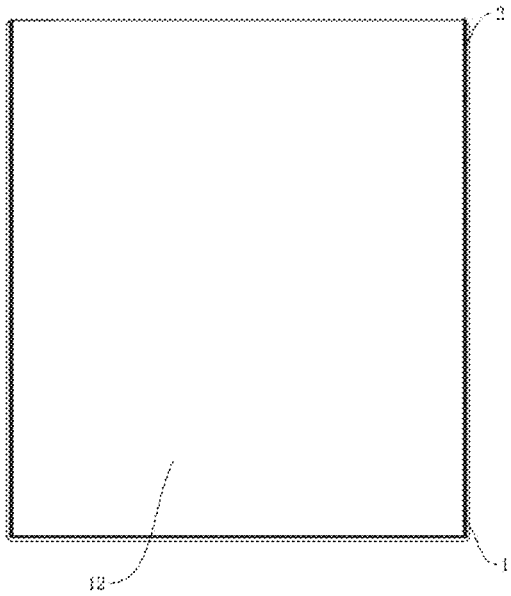
FIG. 4 is an overlooking structure diagram of the softness-adjustable mattress of the disclosure.
Figure 5:
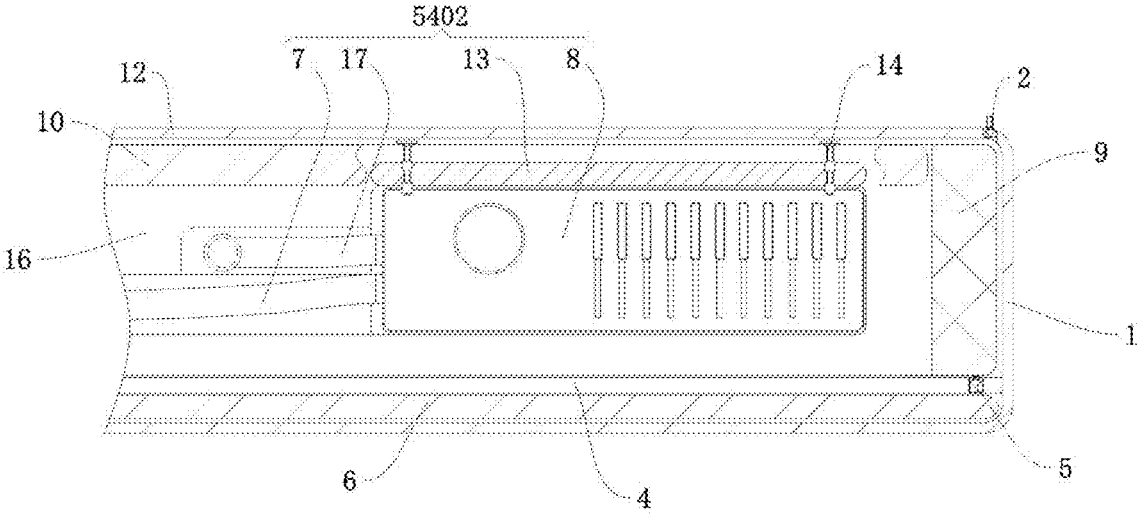
FIG. 5 is a partial enlarged structure diagram of the softness-adjustable mattress of the disclosure.
Figure 6:
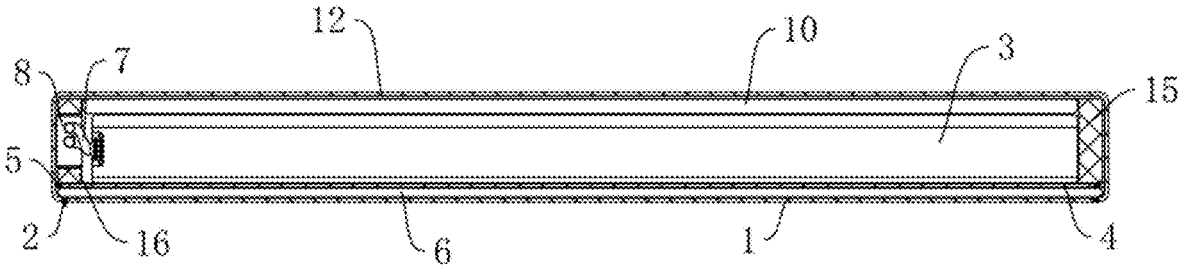
FIG. 6 is a structure diagram for Example 2 of the softness-adjustable mattress of the disclosure.
Figure 7:
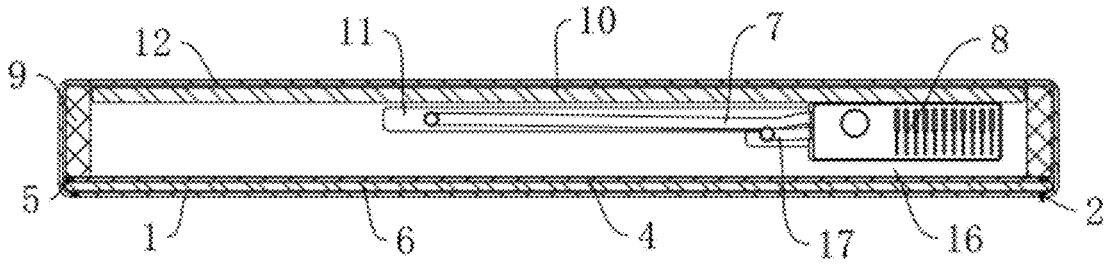
FIG. 7 is a right-viewing sectional structure diagram for Example 2 of the softness-adjustable mattress of the disclosure.
Figure 8:
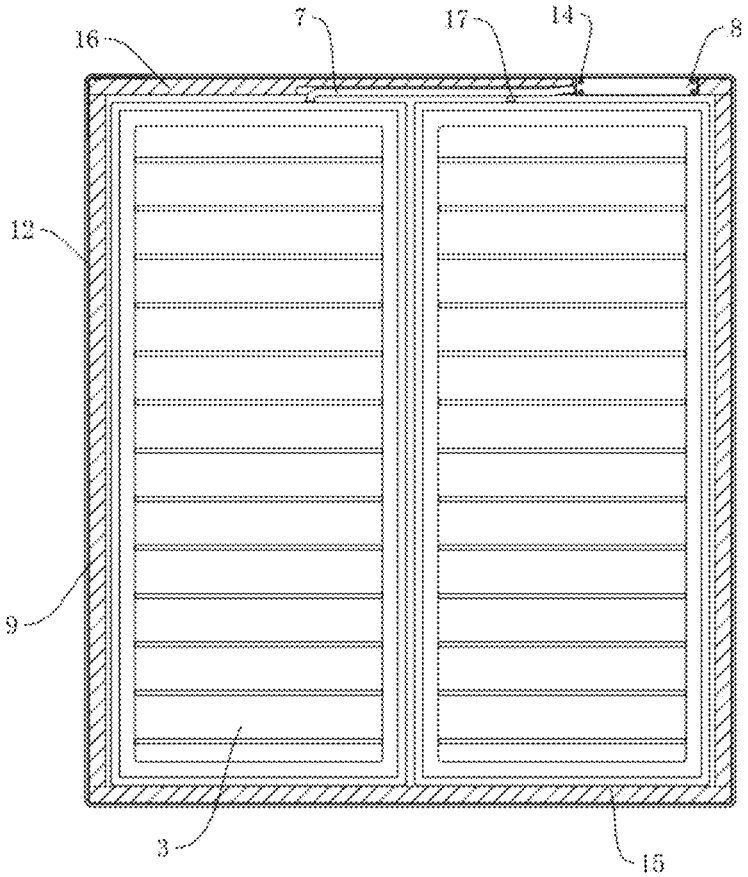
FIG. 8 is an overlooking sectional structure diagram for Example 2 of the softness-adjustable mattress of the disclosure.
Figure 9:
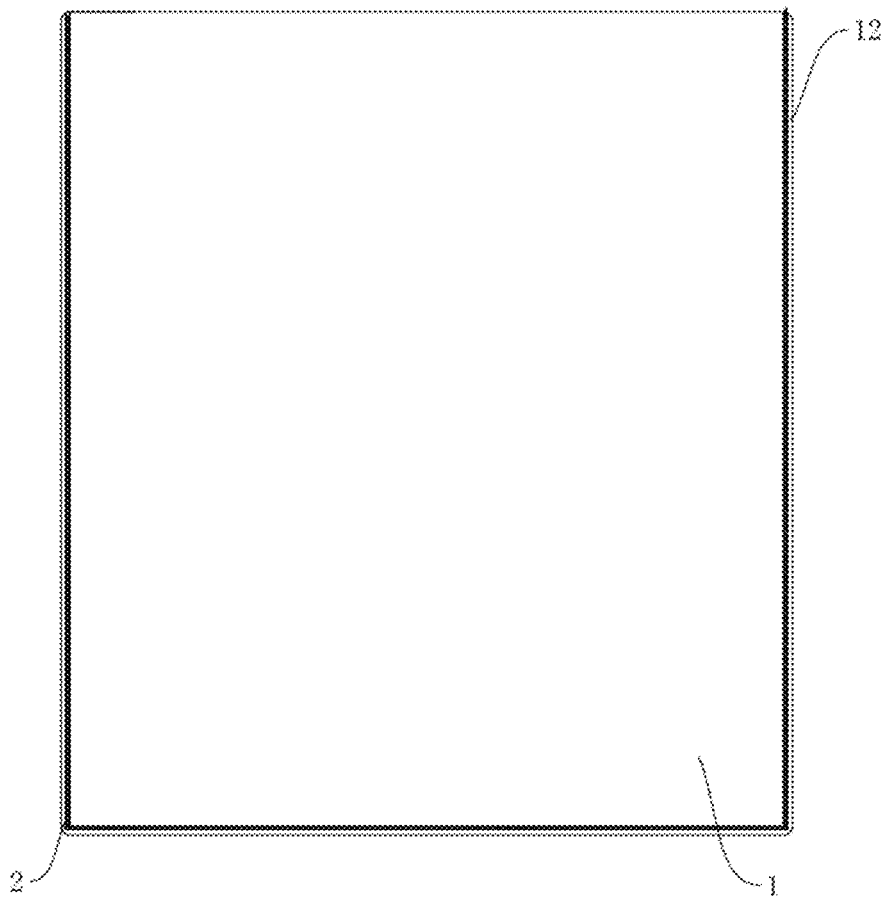
FIG. 9 is an overlooking structure diagram for Example 2 of the softness-adjustable mattress of the disclosure.

In the drawings: 1. Outer lining; 2. Outer lining zipper; 3. Air cushion; 4. Inner lining; 5. Inner lining zipper; 6. Wavy cotton; 7. First conduit; 8. Inflation controller; 9. First spongy strip; 10. Spongy cushion; 11. Trapezoid groove; 12. Bottom lining; 13. Palm-substituent cotton; 14. Bolt; 15. Second spongy strip; 16. Third spongy strip; 17. Second conduit; 310. First surface; 320. Second surface; 331. First side surface; 332. Second side surface; 333. Third side surface; 334. Fourth side surface; 340. Pulling strip; 350. Air valve; 341. First welding part; 342. Second welding part; 240. Pulling strip; 241. First welding part; 242. Second welding part 53. Lying-down mechanism; 54. Inflation mechanism; 5401. First inflation structure; 5402. Second inflation structure; 55. Sealed accommodating cavity.

DESCRIPTION OF THE EMBODIMENTS

With reference to the drawings, the details of the disclosure are described as follows. As shown in FIGS. 1-9, a softness-adjustable mattress, including an outer lining 1, an outer lining zipper 2, and a bottom lining 12, wherein the bottom lining 12 is positioned on the outer lining 1, the outer lining zipper 2 is positioned between the outer lining 1 and the bottom lining 12, a lying-down mechanism 53 is mounted on an inner lower wall face of the outer lining 1, and an inflation mechanism 54 is mounted on the lying-down mechanism 53; wherein the lying-down mechanism 53 comprises: an inner lining 4, an inner lining zipper 5, and wavy cotton 6; the wavy cotton 6 being positioned on the inner lower wall face of the outer lining 1, the inner lining 4 being positioned on the wavy cotton 6, and the inner lining zipper 5 being positioned between the inner lining 4 and the outer lining 1; wherein the inflation mechanism 54 comprises a first inflation structure 5401 and a second inflation structure 5402; the first inflation structure 5401 being positioned on the inner lining 4 and inside of the outer lining 1, and the second inflation structure 5402 being inserted into an inner left side of the first inflation structure 5401; wherein the first inflation structure 5401 comprises: a pair of air cushions 3 of the same structure, a pair of first spongy strips 9 of the same structure, a spongy cushion 10, a second spongy strip 15 and a third spongy strip 16; the pair of the first spongy strips 9 being positioned on the inner front and back wall faces of the outer lining 1 and on the inner lining 4, the second spongy strip 15 being positioned on an inner right wall face of the outer lining 1 and on the inner lining 4, the third spongy strip 16 being positioned on an inner left wall face of the outer lining 1 and on the inner lining 4, the pair of the air cushions 3 being positioned between the pair of the first spongy strips 9, and the spongy cushion 10 being positioned on the pair of the air cushions 3; wherein the second inflation structure 5402 comprises a first conduit 7, an inflation controller 8, a second conduit 17 and palm-substituent cotton 13; the inflation controller 8 being inserted into an inner rear part of the third spongy strip 16, a trapezoid groove 11 being provided on an inner wall face of the third spongy strip 16 and at the front part of the inflation controller 8; the first conduit 7 being provided on a front wall face of the inflation controller 8 and inside of the trapezoid groove 11; the first conduit 7 being connected with the air cushion 3 close to the front part, the second conduit 17 being positioned on the front wall face of the inflation controller 8 and on the first conduit 7, the second conduit 17 being inserted inside of the trapezoid groove 11 and being connected with the air cushion 3 close to the rear part, the palm-substituent cotton 13 being positioned on the inflation controller 8, and the palm-substituent cotton 13 being connected with an inner wall face of the third spongy strip 16; the inflation controller 8 is provided with two pairs of first screw holes of the same structure, and the palm-substituent cotton 13 is provided with two pairs of second screw holes of the same structure, and two pairs of bolts 14 of the same structure are spirally mounted between the two pairs of the first screw holes and the two pairs of the second screw holes; the length of the pair of first spongy strips 9 is larger than that of the second spongy strip 15, and the length of the second spongy strip 15 is the same as that of the third spongy strip 16; the length of the first conduit 7 is larger than that of the second conduit 17; the first conduit 7 is in spiral connection with the air cushion 3 close to the front part, and the second conduit 17 is in spiral connection with the air cushion 3 close to the rear part; the left end face of the bottom lining 12 is in sutured connection with the outer lining 1, and the left end face of the inner lining 4 is in sutured connection with the outer lining 1; the material of the outer lining 1 is polyester fiber.

The characteristics of the present implementation solution is as follows: A softness-adjustable mattress, including an outer lining 1, an outer lining zipper 2, and a bottom lining 12, wherein the bottom lining 12 is positioned on the outer lining 1, the outer lining zipper 2 is positioned between the outer lining 1 and the bottom lining 12, a lying-down mechanism is mounted on an inner lower wall face of the outer lining 1, and an inflation mechanism is mounted on the lying-down mechanism; wherein the lying-down mechanism comprises: an inner lining 4, an inner lining zipper 5, and wavy cotton 6; the wavy cotton 6 being positioned on the inner lower wall face of the outer lining 1, the inner lining 4 being positioned on the wavy cotton 6, and the inner lining zipper 5 being positioned between the inner lining 4 and the outer lining 1; wherein the inflation mechanism comprises a first inflation structure and a second inflation structure; the first inflation structure being positioned on the inner lining 4 and inside of the outer lining 1, and the second inflation structure being inserted into an inner left side of the first inflation structure; wherein the first inflation structure comprises: a pair of air cushions 3 of the same structure, a pair of first spongy strips 9 of the same structure, a spongy cushion 10, a second spongy strip 15 and a third spongy strip 15; the pair of the first spongy strips 9 being positioned on the inner front and back wall faces of the outer lining 1 and on the inner lining 4, the second spongy strip 15 being positioned on an inner right wall face of the outer lining 1 and on the inner lining 4, the third spongy strip 16 being positioned on an inner left wall face of the outer lining 1 and on the inner lining 4, the pair of the air cushions 3 being positioned between the pair of the first spongy strips 9, and the spongy cushion 10 being positioned on the pair of the air cushions 3; wherein the second inflation structure comprises a first conduit 7, an inflation controller 8, a second conduit 17 and palm-substituent cotton 13; the inflation controller 8 being inserted into an inner rear part of the third spongy strip 16, a trapezoid groove 11 being provided on an inner wall face of the third spongy strip 16 and at the front part of the inflation controller 8; the first conduit 7 being provided on a front wall face of the inflation controller 8 and inside of the trapezoid groove 11; the first conduit 7 being connected with the air cushion 3 close to the front part, the second conduit 17 being positioned on the front wall face of the inflation controller 8 and on the first conduit 7, the second conduit 17 being inserted inside of the trapezoid groove 11 and being connected with the air cushion 3 close to the rear part, the palm-substituent cotton 13 being positioned on the inflation controller 8, and the palm-substituent cotton 13 being connected with an inner wall face of the third spongy strip 16. The disclosure can be quickly mounted and dismounted; the air cushion 3 can enhance the overall comfort degree of the mattress, and prevent the integral mattress shape from collapsing; the air cushion can be inflated by the inflation controller 8 at all times, thereby ensuring the stability of the air cushion; users can lie down on the wavy cotton 6, which improves the users' comfort degree and brings convenience to people's life.

Following are the type and function of each component in the present application:

Wavy cotton: being used as a cushion on an air cushion, allowing users to lie down thereon, and thereby enhancing comfort degree.

Following are the type and function of each electric device in the present application:

Inflation controller: Its type is NP06S, and it is used for inflating the air cushion.

One skilled in the art connects all of the electric components in the present application with suitable power source through a wire, and is supposed to choose an appropriate controller according to actual situations, thereby meeting controlling requirements. As for specific connection and control orders, please refer to the following operating principle, which is that each of the electric devices completes electric connection according to its working sequence. Since specific connection means is well-known in this field, following description is mainly about the working principle and process, and there will be no more explanation about electric control.

In the present implementation solution, when the mattress is assembled, first the wavy cotton 6 is positioned between the outer lining 1 and the inner lining 4, and then the inner lining zipper 5 is pulled so that the inner lining 4 and the outer lining 1 are fastened; the wavy cotton 6 is positioned at the bottom of the outer lining 1 so that it won't be moved or fall out, and then the first spongy strip 9, the second spongy strip 15 and the third spongy strip 16 are respectively positioned all around the inner wall of the outer lining 1; one side of the third spongy strip 16, on which the trapezoid groove 11 is provided, is inwardly positioned, and then the inflation controller 8 is inserted into the third spongy strip 16 and is fastened by palm-substituent cotton 13; then a pair of air cushions 3 are positioned among the first spongy strip 9, the second spongy strip 15 and the third spongy strip 16; the first conduit 7 and the second conduit 17 are respectively connected with corresponding air cushions 3; when the external power source of the inflation controller 8 is turned on, the air cushions 3 are inflated, and the spongy cushion 10 is positioned on the air cushions 3; then the outer lining zipper 2 is pulled so that the bottom lining 12 seals the outer lining 1, thereby preventing all of the components inside of the outer lining 1 from falling out; the whole mattress is then turned upside down on the bed, so that the user can lie down on one side of the outer lining 1 covering the wavy cotton 6, as a result of which the comfort degree is ensured.

In this implementation solution, with other structures remain the same, if the position of the outer lining 1 is interchanged with that of the bottom lining 12, the afore-mentioned effect can also be achieved.

In this implementation solution, with other structures remain the same, if the inflation controller 8 is positioned at the central section of the third spongy strip 16, and grooves are provided on both sides of the inflation controller 8, the afore-mentioned effect can also be achieved if the first conduit 7 and the second conduit 17 are positioned at both sides of the inflation controller 8 and are connected with the air cushions through the grooves.

In this implementation solution, the first conduit 7 and the second conduit 17, which have different lengths, can be positioned in the trapezoid groove 11 so as to be connected with the air cushions 3, thereby preventing the first conduit 7 and the second conduit 17 from being sandwiched between the air cushion 3 and the third spongy strip 16, as a result of which the ageing of the conduits after a long term service can be avoided.

In this implementation solution, the air cushions can be inflated by the inflation controller 8 when the air inside of the air cushions 3 is insufficient, thereby ensuring the comfort degree and stability of the mattress.

Furthermore, the mattress of the disclosure includes a first surface, a second surface, side surfaces and pulling strips. Wherein the first surface and the second surface are respectively connected with side surfaces, thereby forming a sealed accommodating cavity 55. The pulling strips are within the accommodating cavity; one end of the pulling strip is provided on one side of the first surface facing the accommodating cavity, and the other end of the pulling strip is provided on one side of the second surface facing the accommodating cavity. The pulling strips play the role of keeping the first surface and the second surface flat when the accommodating cavity is inflated.

In the disclosure, the first surface and the second surface may have an identical shape. In the state of inflation, the first surface and the second surface are provided up and down in a parallel or substantive parallel manner. In some implementation solutions, the first surface serves as an upper surface, and the second surface serves as the lower surface. In other implementation solutions, the first surface serves as the lower surface, and the second surface serves as the upper surface. Both the first surface and the second surface can serve as the surface of the air cushion for bearing external pressure, e.g. the surface of the softness-adjustable mattress for bearing human weights.

Side surfaces of the disclosure are side structures used for connecting the first surface and the second surface so as to form the air cushion in an inflated state. In some implementation solutions, side surfaces are quadrilateral and each includes a first edge, a second edge, a third edge and a fourth edge. The first edges are connected with the edges of the first surface, the third edges are connected with the edges of the second surface, and the second edges and the fourth edges are interconnected, thereby forming a sealed accommodating cavity. Since the edges of the first or second surface are respectively connected with the side surfaces, excessive deformation of the edges of the first or second surface for bearing external pressure (e.g. the pressure developed when a human body sits) will be avoided and usage will not be affected. In some implementation solutions, the first surface and the second surface are respectively quadrilateral, and each side surface includes a first side surface, a second side surface, a third side surface and a fourth side surface. Each side surface respectively includes four edges, and two edges (which meanwhile are the two longer ones) of the first side surface are respectively connected with the first edge of the first surface and the first edge of the second surface. Two edges (which meanwhile are the two longer ones) of the second side surface are respectively connected with the second edge of the first surface and the second edge of the second surface. Two opposing edges (which meanwhile are the two longer ones) of the third side surface are respectively connected with the third edge of the first surface and the third edge of the second surface. Two edges (which meanwhile are the two longer ones) of the fourth side surface are respectively connected with the fourth edge of the first surface and the fourth edge of the second surface. Besides, two edges (which meanwhile are the two shorter ones) of the first side surface are respectively connected with one shorter edge of the second side surface and one shorter edge of the fourth side surface. The other shorter edge of the second side surface is connected with one shorter edge of the third side surface, and the other shorter edge of the third side surface is connected with one shorter edge of the fourth side surface. Thus, the first side surface, the second side surface, the third side surface and the fourth side surface are interconnected, thereby forming a cuboid sealed accommodating cavity together with the first surface and the second surface. The structure of connecting parts (i.e. the formed angular portions) between surfaces of the air cushion of the disclosure is more favorable for maintaining a specific shape when the product is inflated, and is capable of bearing stronger external pressure.

In the disclosure, the thickness of the first surface, that of the second surface and that of the side surfaces are usually 0.01-2 cm, preferably 0.05-1 cm, and more preferably 0.1-0.5 cm. The thickness of the first surface, that of the second surface and that of the side surfaces may be identical or not. For example, the thickness of the first surface is identical with that of the second surface, but the thickness of the pulling strip is greater than this thickness, thereby enhancing tensile strength of the pulling strip.

The number of the pulling strips in the disclosure is preferably to be multiple, so as to be favorable for maintaining the first surface and the second surface flat when the accommodating cavity is being inflated. The shape of the pulling strips is not particularly defined. For example, it can be a long strip, a cylindrical shape, a short column and so on. The pulling strip having a long strip shape is preferably a long strip with a certain width and length. The pulling strip having a cylindrical shape is preferably a cylinder formed of cloth strips, wherein one end of the cylinder is connected with the first surface, and the other end of the cylinder is connected with the second surface. The pulling strip having a short column shape is preferably a column formed of cloth strips and having a quadrilateral section, wherein one end of the short column is connected with the first surface and the other end of the short column is connected with the second surface. In the disclosure, pulling strips having one of the afore-mentioned shapes, or a combination of pulling strips having different shapes can be used. The positions for providing the pulling strips are not particularly defined, preferably, at least a part of the pulling strips are provided on the edges of the first or second surface. The arrangement in this way is favorable of maintaining a structure capable of bearing human weights at the edge part when the product is under pressure in an inflated state. In a preferable technical solution, pulling strips having a long strip shape are provided in a direction parallel to one edge of the first surface or one edge of the second surface, and edge parts of the first and second surfaces are provided with multiple pulling strips having a short column shape. Spaces between the multiple pulling strips are not particularly defined, but are preferably to be sufficient for bearing human weights. The pulling strips of the disclosure can be connected with the first or second surface via welding parts.

In the disclosure, the connection between the first or second surface and the side surfaces, as well as the connection between the pulling strips and the first or second surfaces can be performed by means of, for instance, hot melting, high frequency welding or glue bonding. The connection is preferably realized by means of hot melting.

As for the air cushions of the disclosure, the first surface, the second surface and side surfaces are respectively made of a flexible impermeable material. Different from general air cushions, the air cushions of the mattress in the disclosure are in a long-term inflated state, so the surfaces of the air cushions keep bearing a certain stress over a long period of time. Moreover, for instance, when a human body is on the air cushion, the stresses applied on the air cushion surfaces constantly change due to the movement or position change of the human body. These stresses and changes thereof raise high requirements on the properties (especially the durability and so on) of the flexible impermeable material. The flexible impermeable material is developed specific to the air cushions of the disclosure; it has excellent elongation, tearing strength, hysteresis effect, flexibility and tensile strength; moreover, it also has excellent abrasion resistance, thermal ageing resistance and stress resistance. Preferably, the flexible impermeable material comprises a base material and a polymer material layer.

The base material of the disclosure is used for supporting the polymer material layer, and for enhancing the strength of the polymer material layer at the same time. Examples of the base material include but are not limited to Nylon cloth, polyester cloth, non-woven cloth, cotton cloth, nylon silk, netting cloth, textiles and leather. The disclosure may use one kind or a combination of several kinds of the aforementioned base materials, preferably use cotton cloth, and more preferably use 100% cotton cloth. If cotton cloth is used, it is preferable that the cotton cloth of the disclosure does not contain metals (especially copper, manganese), glue, artificial resin or metal salt and so on. In some implementation solutions, the density of the cotton cloth is as follows: warp/weft is 228/220 or greater (a sample of 10 cm×10 cm). The warp-wise tensile strength of the base material usually is 350N or more, preferably is 400N or more, and more preferably is 500N or more. The weft-wise tensile strength of the base material usually is 350N or more, preferably is 400N or more, and more preferably is 500N or more. The measurement of the warp-wise tensile strength and weft-wise tensile strength is based on a sample of 5 cm×20 cm and is performed according to GB/T528-2009 standard (100 mm/min). The warp-wise tearing strength of the base material usually is 45N or more, preferably is 50N or more, and more preferably is 60N or more. The weft-wise tearing strength of the base material usually is 50N or more, preferably is 55N or more, and more preferably is 60N or more. The measurement of the tearing strength of the base material is performed based on a sample of 5 cm×20 cm×23 cm (100 mm/min).

The tensile strength of the polymer material of the disclosure is 8 MPa or more, preferably is 10 MPa or more, and more preferably is 15 MPa or more. The measurement of this tensile strength is performed under 100 mm/min according to GB/T528-2009 standard. The elongation of the polymer material is 400% or more, preferably is 450% or more, and more preferably is 500% or more. The measurement of this elongation is performed under 100 mm/min according to GB/T528-2009 standard.

The polymer material of the disclosure is prepared from raw materials containing natural rubber, styrene butadiene rubber(SBR), rosin resin, bis-((3-methyl-2,5-dioxopyrrol-1-yl)methyl)benzol and thiols, wherein the amount of the natural rubber is 65-75 parts by weight, preferably is 67-73 parts by weight, and also preferably is 68-71 parts by weight. If the amount of the natural rubber is smaller than 65 parts by weight, the tearing strength and the tensile strength tend to weaken, and the adhesive strength of the polymer material and the base material will be reduced. On the other hand, if the amount of the natural rubber is excessively large, the abrasion resistance and workability of the polymer material will be lowered. The amount of styrene butadiene rubber is 25-35 parts by weight, preferably is 26-34 parts by weight, and more preferably is 28-32 parts by weight. Styrene butadiene rubber within the afore-mentioned range is favorable of making the polymer material have suitable ageing resistance and abrasion resistance. If the amount of styrene butadiene rubber is excessively large, the tearing strength and the tensile strength tend to weaken. If the amount of styrene butadiene rubber is excessively small, then the purpose of being ageing resistant or abrasion resistant will not be achieved.

Since the material flexibility and other properties of the base material are different from those of the polymer material layer, the deformation amount of the base material under stresses is different from that of the polymer material layer, which weakens the combination between the base material and the polymer material layer. As a result, when stress variations occur constantly and repeatedly at intervals, the base material and the polymer material layer may be separated, which affects the air tightness and the service life of the inflation material. It is discovered in the disclosure that the flexibility of the base material and that of the polymer material layer tend to be identical when a suitable amount of rosin resin is added to the polymer material, and the bonding between them can be improved, thereby greatly extending the service life. In the disclosure, the amount of rosin resin usually is 1-5 parts by weight, and the rosin resin within this range is favorable of enhancing combination of the polymer material and the base material (especially the cotton cloth). If the amount of rosin resin is excessively large, the tearing strength and the tensile strength will be lowered, or even cannot reach the strength required by the air cushions.

In the disclosure, it is found out that the use of bis-((3-methyl-2,5-dioxopyrrol-1-yl)methyl)benzol and thiols can greatly extend the service life of the air cushions. The reason is not clear yet, but it is inferred by the inventor that the possible reason may lie in the molecular chain breakage of the internal grid structure of the polymer material caused by uneven stress distribution during long-term use. When the molecular chain is pulled apart, free radials will be generated, and oxidation chain reaction will be caused. As a result, the performances of the polymer material layer will be affected. By using chain transfer, the bis-((3-methyl-2,5-dioxopyrrol-1-yl)methyl)benzol of the disclosure can terminate the oxidation chain reaction, and thus reduce the unfavorable effect produced by the molecular chain breakage. Furthermore, the thiols of the disclosure can transfer the free radials (especially ROOH) generated after molecular chain breakage to a form of non-free radial group, thereby preventing chain initiation. Through coordination between different mechanism, bis-((3-methyl-2,5-dioxopyrrol-1-yl)methyl)benzol and thiols maintain the stability of the internal molecular grid structure of the materials.

In the disclosure, the amount of bis-((3-methyl-2,5-dioxopyrrol-1-yl)methyl)benzol usually is 1-5 parts by weight, and preferably is 2-4 parts by weight. If the amount of bis-((3-methyl-2,5-dioxopyrrol-1-yl)methyl)benzol is excessively large, blooming may be caused. Besides, the amount of thiols in the disclosure usually is 2-5 parts by weight, and preferably is 2.5-4 parts by weight. In the disclosure, the mole ratio between bis-((3-methyl-2,5-dioxopyrrol-1-yl)methyl)benzol and thiols is 0.8:1-1.2:1.

The flexible impermeable material of the disclosure can be prepared by using methods well-known in this field. Exemplary method includes a step of mixing a required amount of natural rubber, styrene butadiene rubber and rosin resin and heating them at a temperature of 130-150° C. till they melt, and a step of adding a required amount of bis-((3-methyl-2,5-dioxopyrrol-1-yl)methyl)benzol and thiols to the mixture and stirring them till the mixture is even. The polymer material is obtained after cooling. This polymer material is then melt under a high temperature and is applied to both sides of the base material by means of coating, rolling and so on, and the flexible permeable material of the disclosure is thus obtained. In the flexible permeable material of the disclosure, the polymer material takes 40-55%, preferably 45-50%, of the total weight, e.g. 46.3%.

It should be noted that antibacterial processing is preferably performed for the base material or polymer material. Exemplary processing steps including using a TH22-27 product of Sanitized to perform the antibacterial processing for the base material, and the amount is 4% (5.4 g/M2). The antibacterial processing for the polymer material of the disclosure uses a PL21-60 product of Sanitized, the amount is 0.04% (0.3 g/M2), and the class is required to be not higher than Class 1.

Example 3-1

Figure 10:
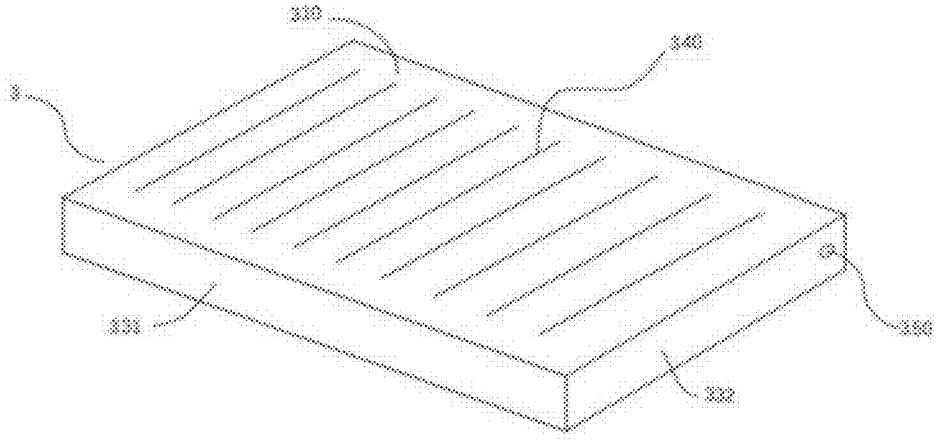
FIG. 10 is a perspective view for the air cushion 3 of the softness-adjustable mattress of the disclosure.
Figure 11:
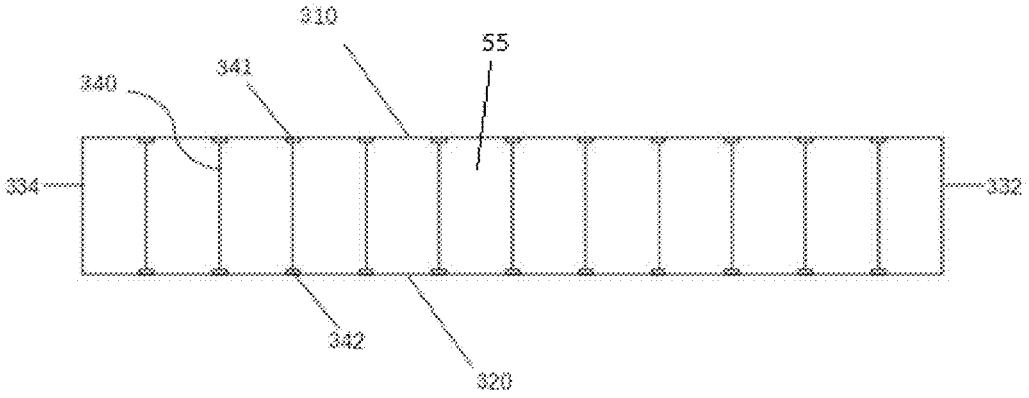
FIG. 11 is a longitudinal sectional view for the air cushion 3 of the softness-adjustable mattress of the disclosure.
Figure 12:
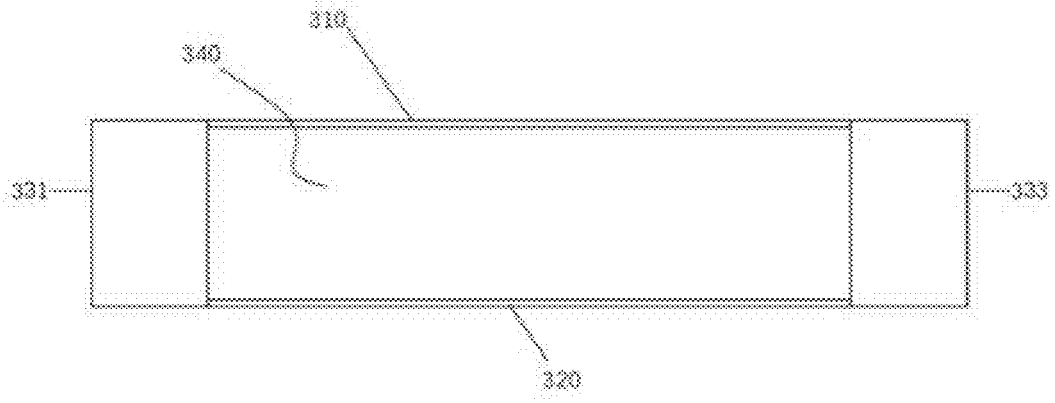
FIG. 12 is a transverse sectional view for the air cushion 3 of the softness-adjustable mattress of the disclosure.

The present example is an air cushion of a mattress serving as a piece of indoor furniture. FIG. 10 is a perspective view for the exemplary air cushion 3. FIG. 11 is a longitudinal sectional view for the exemplary air cushion 3. FIG. 12 is a transverse sectional view for the exemplary air cushion 3.

As shown in FIGS. 10-11, the air cushion 3 includes a first surface 310, a second surface 320, four side surfaces, multiple pulling strips 340 and an air valve 350.

The first surface 310 serves as an upper surface of the air cushion 3, the second surface 320 serves as a lower surface of the air cushion 3, and both the first surface 310 and the second surface 320 are rectangle. Side surfaces include a first side surface 331, a second side surface 332, a third side surface 333 and a fourth side surface 334. A first edge of the first surface 310 is connected with the upper edge of the first side surface 331, a second edge of the first surface 310 is connected with the upper edge of the second side surface 332, a third edge of the first surface 310 is connected with the upper edge of the third side surface 333, and a fourth edge of the first surface 310 is connected with the upper edge of the fourth side surface 334. A first edge of the second surface 320 is connected with the lower edge of the first side surface 331, a second edge of the second surface 320 is connected with the lower edge of the second side surface 332, a third edge of the second surface 320 is connected with the lower edge of the third side surface 333, and a fourth edge of the second surface 320 is connected with the lower edge of the fourth side surface 334. The right edge of the first side surface 331 is connected with the left edge of the second side surface 332, the right edge of the second side surface 332 is connected with the left edge of the third side surface 333, the right edge of the third side surface 333 is connected with the left edge of the fourth side surface 334, and the right edge of the fourth side surface 334 is connected with the left edge of the first side surface 331. The upper edges and the lower edges are respectively the longer edges of the side surfaces. The right edges and the left edges are respectively the shorter edges of each of the side surfaces. The afore-mentioned "connection" refers to the bonding connection of the edges by means of hot melting. The afore-mentioned connection method enables the air cushion to form a cuboid structure after being inflated, and is capable of ensuring that all of the edges or corners of the inflated cuboid can bear a certain pressure, thereby preventing serious depressions.

The pulling strips 340 in this Example have a long strip shape, and the number is multiple. The pulling strips are respectively provided along the short edges of the first or second surface, that is parallel to the short edges. A first welding part 341 and a second welding part 342 are respectively provided on both ends of each pulling strip 340. Together with the first welding part 341 and the second welding part 342, the pulling strip 340 forms a "工" character shape. The upper and lower parts of the "工" character shape structure are respectively in welding connection with the first surface and the second surface.

In this Example, the air valve 350 is provided on a second side surface 332, and controls the inflation amount inside of the air cushion 3 or controls to completely discharge the air therein.

In this Example, the first surface 310, the second surface 320 and all side surfaces are respectively made of a flexible impermeable material. The flexible impermeable material comprises cotton cloth and a polymer material layer provided on the cotton cloth surface.

The cotton cloth is 100% cotton cloth, and is free from copper, manganese, glue, artificial resin or metal salt. Wherein:

Density: warp/weft Minimum 228/220(a sample of 10 cm*10 cm)

Color: Cloth color

Yarn size: a yarn of 21*21

Surface code: 90-White

Tensile strength: warp/weft Minimum 350N/350N (a sample of 5 cm*20 cm, 100 mm/min)

Tearing strength: warp/weft 50N/53N minute (a sample of 5 cm*20 cm*23 cm, 100 mm/min).

The polymer material comprises 70 parts by weight of natural rubber, 30 parts by weight of styrene butadiene rubber (GB8659-88), 3 parts by weight of rosin resin, 3 parts by weight of bis-((3-methyl-2,5-dioxopyrrol-1-yl)methyl)benzol, and 4 parts by weight of 2-mercaptobenzimidazole.

Example 3-2

Figure 13:
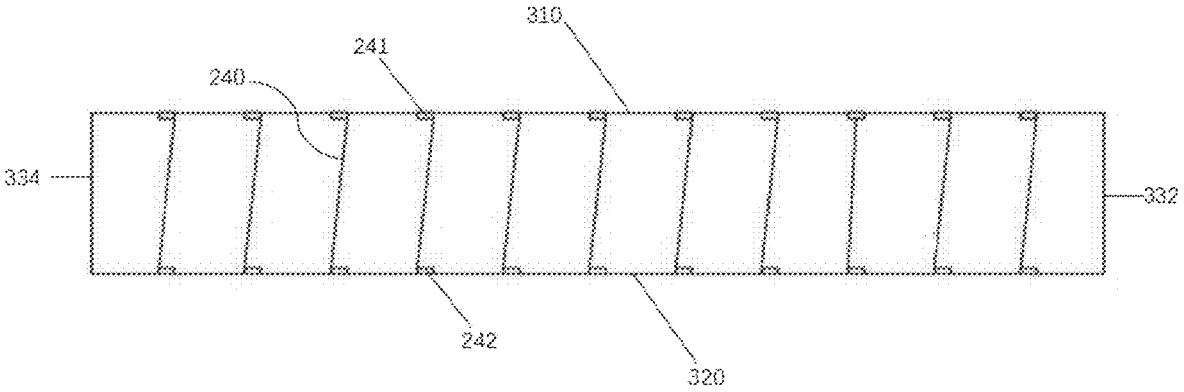
FIG. 13 is a longitudinal sectional view for another exemplary air cushion of the softness-adjustable mattress of the disclosure.

The polymer material in Example 3-1 is replaced by the material described as follows, and the pulling strip is changed as shown in FIG. 13, while other structures are the same as the air cushion in Example 3-1.

The polymer material comprises 73 parts by weight of natural rubber, 32 parts by weight of styrene butadiene rubber (GB8659-88), 3 parts by weight of rosin resin, 4 parts by weight of bis-((3-methyl-2,5-dioxopyrrol-1-yl)methyl)benzol, and 5 parts by weight of 2-mercaptobenzimidazole.

FIG. 13 is a longitudinal sectional view for another exemplary air cushion. As shown in FIG. 13, the structure of the pulling strip 240 is different from the pulling strip 340 in Example 3-1, while other parts remain the same as those in Example 3-1. In this Example, two ends of the pulling strip 240 include a first welding part 241 and a second welding part 242, and the pulling strip 240 forms a "Z" character shape structure together with the first welding part 241 and the second welding part 242. The upper and lower parts of the "Z" character shape structure are respectively in welding connection with the first surface and the second surface.

Comparative Example 1

Except for that the polymer material does not comprise any bis-((3-methyl-2,5-dioxopyrrol-1-yl)methyl)benzol component, other structures are the same as those in Example 1.

Comparative Example 2

Except for that the polymer material does not comprise any thiols component, other structures are the same as those in Example 1.

Comparative Example 3

Except for that the polymer material does not comprise bis-((3-methyl-2,5-dioxopyrrol-1-yl)methyl)benzol and thiols components, other structures are the same as those in Example 1.

Test Examples

1. Hardness of flexible impermeable materials is tested according to the regulations in GB/T 528-2009. The results are shown in Table 1 as below.

2. Durability of all test samples is tested according to the method below:

At room temperature, test samples each having a size of 50 cm×30 cm×0.5 cm are taken and two ends of all test samples are fixed along the length direction. A burden of 50 kg, which lasts for 0.5 seconds, is applied to the samples per minute, and the number of cycles of a phenomenon starting from the stress softening occurring inside of the polymer material (Stage I), damages produced on the surface or inside of the material (Stage II), crack initiation caused by damages, through continuous extension till fracture failure (Stage III) inside of the polymer material of samples are recorded. The results are shown in Table 1 below.

3. Impermeability tests

Under the experimental conditions mentioned in the above Item 2, the tightness of all samples is tested after the circular application of burden for 15,000 times.

TABLE 1

| Performances | Example 3-1 | Example 3-2 | Comparative Example 1 | Comparative Example 2 | Comparative Example 3 |
|---|---|---|---|---|---|
| Hardness (Shore A) | 53 | 56 | 52 | 48 | 53 |
| Stage I | 20000 | 20000 | 14000 | 15000 | 12000 |
| Stage II | 25000 | 25000 | 18000 | 20000 | 13000 |
| Stage III | 30000 | 30000 | 20000 | 20000 | 20000 |
| Tightness | Excellent | Excellent | Poor | Poor | Poor |

The afore-mentioned technical solutions merely represent the optimal ones of the disclosure; some possible alternations made by one skilled in the art to some parts of the technical solution also represent the principle of the disclosure, and fall in the protection scope of the disclosure.

The invention claimed is:

1. A softness-adjustable mattress, including an outer lining, an outer lining zipper, and a bottom lining, characterized in that: the bottom lining is positioned on the outer lining, the outer lining zipper is positioned between the outer lining and the bottom lining, a lying-down mechanism is mounted on an inner lower wall face of the outer lining, and an inflation mechanism is mounted on the lying-down mechanism;

wherein the lying-down mechanism comprises: an inner lining, an inner lining zipper, and wavy cotton;

the wavy cotton being positioned on the inner lower wall face of the outer lining, the inner lining being positioned on the wavy cotton, and the inner lining zipper being positioned between the inner lining and the outer lining;

wherein the inflation mechanism comprises a first inflation structure and a second inflation structure;

the first inflation structure being positioned on the inner lining and inside of the outer lining, and the second inflation structure being inserted into an inner left side of the first inflation structure;

wherein the first inflation structure comprises: a pair of air cushions of the same structure, a pair of first spongy strips of the same structure, a spongy cushion, a second spongy strip and a third spongy strip;

the pair of the first spongy strips being positioned on the inner front and back wall faces of the outer lining and on the inner lining, the second spongy strip being positioned on an inner right wall face of the outer lining and on the inner lining, the third spongy strip being positioned on an inner left wall face of the outer lining and on the inner lining, the pair of the air cushions being positioned between the pair of the first spongy strips, and the spongy cushion being positioned on the pair of the air cushions;

wherein the second inflation structure comprises a first conduit, an inflation controller, a second conduit and palm-substituent cotton;

the inflation controller being inserted into an inner rear part of the third spongy strip, a trapezoid groove being provided on an inner wall face of the third spongy strip and at the front part of the inflation controller; the first conduit being provided on a front wall face of the inflation controller and inside of the trapezoid groove; the first conduit being connected with the air cushion proximate to the front part, the second conduit being positioned on the front wall face of the inflation controller and on the first conduit, the second conduit being inserted inside of the trapezoid groove and being connected with the air cushion proximate to the rear part, the palm-substituent cotton being positioned on the inflation controller, and the palm-substituent cotton being connected with an inner wall face of the third spongy strip.

2. The softness-adjustable mattress according to claim 1, characterized in that the air cushion comprises a first surface, a second surface, a side surface and pulling strips, wherein:

the first surface has the same shape as the second surface, and the first surface, the second surface and the side surface are respectively made of a flexible impermeable material;

the first surface and the second surface are respectively connected with the side surface, thereby forming a sealed accommodating cavity;

the pulling strips are located within the accommodating cavity, one end of the pulling strip is provided on one side of the first surface facing the accommodating cavity, and the other end of the pulling strip is provided on one side of the second surface facing the accommodating cavity, thereby allowing the first surface and the second surface to keep flat when the accommodating cavity is inflated.

3. The softness-adjustable mattress according to claim 2, characterized in that: the side surface include a first edge, a second edge, a third edge and a fourth edge, wherein the edges of the first surface are connected with the first edges of the side surface, the edges of the second surface are connected with the third edges of the side surface, the second edges of the side surface are connected with the fourth edges of the side surface, thereby forming a sealed accommodating cavity.

4. The softness-adjustable mattress according to claim 2, characterized in that: the first surface and the second surface are respectively quadrilateral, and the side surface includes a first side surface, a second side surface, a third side surface and a fourth side surface, wherein the first side surface is respectively connected with a first edge of the first surface and a first edge of the second surface, the second side surface is respectively connected with a second edge of the first surface and a second edge of the second surface, the third side surface is respectively connected with a third edge of the first surface and a third edge of the second surface, the fourth side surface is respectively connected with a fourth edge of the first surface and a fourth edge of the second surface, and the first side surface, the second side surface, the third side surface and the fourth side surface are interconnected, thereby forming a cuboid sealed accommodating cavity.

5. The softness-adjustable mattress according to claim 2, characterized in that: the flexible impermeable material comprises a base material and a polymer material layer provided on the surface of the base material, the polymer material layer being prepared from raw materials containing natural rubber, styrene butadiene rubber, rosin resin, bis-((3-methyl-2,5-dioxopyrrol-1-yl)methyl)benzol and thiols.

6. The softness-adjustable mattress according to claim 5, characterized in that: in the polymer material layer, the natural rubber is 65-75 parts by weight, the styrene butadiene rubber is 25-35 parts by weight, the rosin resin is 1-5 parts by weight, the bis-((3-methyl-2,5-dioxopyrrol-1-yl) methyl)benzol is 1-5 parts by weight, and the thiols is 2-5 parts by weight.

7. The softness-adjustable mattress according to claim 1, characterized in that: the inflation controller is provided with two pairs of first screw holes of the same structure, and the palm-substituent cotton is provided with two pairs of second screw holes of the same structure, and two pairs of bolts of the same structure are spirally mounted between the two pairs of the first screw holes and the two pairs of the second screw holes.

8. The softness-adjustable mattress according to claim 1, characterized in that: a length of the first spongy strip is larger than that of a second spongy strip, and the length of the second spongy strip is the same as that of the third spongy strip.

9. The softness-adjustable mattress according to claim 1, characterized in that: the first conduit is in spiral connection with the air cushion proximate to the front part, and the second conduit is in spiral connection with the air cushion proximate to the rear part.

10. The softness-adjustable mattress according to claim 1, characterized in that: the left end face of the bottom lining is in sutured connection with the outer lining, and the left end face of the inner lining is in sutured connection with the outer lining.

* * * * *